US006518884B1

(12) United States Patent
Tanji et al.

(10) Patent No.: US 6,518,884 B1
(45) Date of Patent: Feb. 11, 2003

(54) ELECTRIC RESONANCE ELEMENT, DETECTION APPARATUS AND MOVING VEHICLE CONTROL SYSTEM

(75) Inventors: Yoshihiko Tanji, Osaka (JP); Keiji Yasui, Hyogo (JP); Toshihiro Yoshioka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/272,776

(22) Filed: Mar. 29, 1999

(30) Foreign Application Priority Data

Mar. 27, 1998 (JP) ..... 10-080847

(51) Int. Cl.[7] ..... G08B 13/14

(52) U.S. Cl. ..... 340/572.1; 340/572.4; 340/572.5; 340/572.7; 340/572.8

(58) Field of Search ..... 340/572.1, 572.4, 340/572.5, 572.7, 572.8

(56) References Cited

U.S. PATENT DOCUMENTS

| | | | | | |
|---|---|---|---|---|---|
| 3,740,742 | A | * | 6/1973 | Thompson et al. | 340/224 |
| 3,895,368 | A | * | 7/1975 | Gordon et al. | 340/280 |
| 4,361,202 | A | | 11/1982 | Minovitch | 180/168 |
| 4,376,931 | A | | 3/1983 | Komatu et al. | 340/58 |
| 4,609,911 | A | * | 9/1986 | Nourse et al. | 340/572 |
| 4,712,094 | A | * | 12/1987 | Bolson, Sr. | 340/572 |
| 5,499,015 | A | * | 3/1996 | Winkler et al. | 340/571 |
| 5,506,584 | A | | 4/1996 | Boles | 340/825.34 |
| 5,517,179 | A | | 5/1996 | Charlot, Jr. | 340/572 |
| 5,661,470 | A | * | 8/1997 | Karr | 340/572 |
| 5,748,085 | A | * | 5/1998 | Davis et al. | 340/572 |
| 5,751,213 | A | * | 5/1998 | Asbrink | 340/572 |
| 5,758,276 | A | * | 5/1998 | Shirakawa et al. | 455/324 |
| 5,955,951 | A | * | 9/1999 | Wischerop et al. | 340/572.8 |
| 6,049,279 | A | * | 4/2000 | Minarovic | 340/572.8 |
| 6,067,235 | A | * | 5/2000 | Finn et al. | 340/573.1 |

FOREIGN PATENT DOCUMENTS

| | | |
|---|---|---|
| JP | 07 244788 | 9/1995 |
| WO | WO 93/14478 | 7/1993 |

OTHER PUBLICATIONS

Search Report Application No. 99105109 dated Oct. 5, 2000.

* cited by examiner

*Primary Examiner*—Benjamin C. Lee
*Assistant Examiner*—Hung Nguyen
(74) *Attorney, Agent, or Firm*—RatnerPrestia

(57) ABSTRACT

An electric resonance element includes an electric resonator comprising a coil wound around magnetic materials and a capacitor. The electric resonance element is housed in a vessel made of non-magnetic materials. A detection apparatus for detecting the electric resonance element comprises a transmitter for transmitting an electromagnetic wave and a receiver for detecting the echo wave transmitted from the electric resonance element. A moving vehicle is controlled using a system which comprises the electric resonance element buried in a road, and the detection apparatus installed on a vehicle for detecting echo waves transmitted from electric resonance elements. The detection apparatus comprises a transmitter for transmitting an electromagnetic wave specific to the electric resonance element, a receiver that detects the echo wave, and a element or a circuit to suspend the operation of the receiver while the transmitter is on duty.

9 Claims, 3 Drawing Sheets

ELECTRIC RESONANCE ELEMENT, DETECTION APPARATUS AND MOVING VEHICLE CONTROL SYSTEM

FIELD OF THE INVENTION

The present invention relates to a device for automatically operating a vehicle, or for providing a vehicle driver with road information in support of the driving activity, and a system for controlling a moving vehicle employing such device. More specifically, the present invention relates to an electric resonance element buried in a road, a detection apparatus for detecting the electric resonance element, and a system which includes the above items for controlling a moving vehicle.

BACKGROUND OF THE INVENTION

Information about roads and information needed for driving a vehicle has been exhibited to a driver by means of a lane mark, a road sign and the like. These are recognized by the vehicle driver by using his eyes. However, it may be not easy to recognize and understand the information through the human eyes especially during rough weather or at night. The safety of vehicle drivers under such circumstances has not been assured.

Experiments are under way for an automatic vehicle driving system. In such a system, a sensor installed in a vehicle detects magnetic markers provided on a road and an automatic driving equipment controls the vehicle based on information delivered from the sensor. The sensor uses magnetics. Such a sensor, however, has a relatively great possibility of errors due to magnetic turbulence. Therefore, a system that assists in the driving of a vehicle by exchange of information by means of electromagnetic waves would be desirable.

Among the information exchange means using electromagnetic waves is a method that uses the phenomenon of electric resonance. The method has been in use as an anti-theft system used in retail shops for preventing the stealing of a merchandise. The system comprises an electric resonator shaped in the form of a film, which is attached to merchandise, and a detection apparatus disposed at the exit of shop. The film-shaped electric resonator comprises a coil made from metal foil and a chip capacitor.

Under the above described system, however, only an electric resonance of high frequency can be used, because the inductance of the coil made from metal foil is small and the capacitance of the chip capacitor is small. For the above reasons, a detection method based on the electric resonance phenomenon normally uses an electromagnetic wave of several megahertz, and the detection is conducted through a phase detection method.

In the above described conventional detection apparatus using the electric resonance phenomenon, however, the level of an input signal of an electromagnetic wave transmitted from an electric resonance element detected at the detector is extremely small as compared with the output level of a call-on electromagnetic wave transmitted (hereinafter called as transmitting wave). As a result, it is difficult to detect the phase of an input signal based on the phase of the transmission wave.

Described practically, the signal level of an input signal at the above described detection apparatus is normally about several millionths of that of the transmitting wave. This means that if a detection apparatus is located away from an electric resonance element, it can not detect the signal, and the directivity of the signal is not sufficient either. Especially, in a case where a transmitting antenna and a receiving antenna are independently provided, a substantial interference is caused by the transmitting wave on the receiving.

SUMMARY OF THE INVENTION

An electric resonance element in accordance with an exemplary embodiment of the present invention (hereinafter referred to as resonance device) comprises a coil and a capacitor which determine a frequency of a specific electric resonance (resonance frequency), and a magnetic core having an approximately plate or rod shape which concentrates and selectively amplifies the high frequency magnetic flux of a transmitting wave. The invented resonance device is housed in a sealed vessel provided for protecting the capacitor, core, etc. from deterioration.

A detection apparatus for detecting the electric resonance element in accordance with an exemplary embodiment of the present invention (hereinafter referred to as detection apparatus) comprises a transmitting section for transmitting an electromagnetic wave of the resonance frequency of said resonance device, a receiving section for detecting an electromagnetic wave transmitted from the resonance device, and means for keeping the receiving section inert while the transmitting section is transmitting the electromagnetic wave of the resonance frequency.

An exemplary transmitting section comprises:

a) a discharge resistor for instantaneously suspending transmission of a signal when the detection apparatus is alternated to a receiving made from a transmitting mode, b) a function of transmitting electromagnetic waves in a plurality of frequencies, c) tuning capacitors corresponding to a plurality of resonance frequencies, and d) means to select a tuning capacitor among the tuning capacitors in accordance with the resonance frequency to be oscillated.

An exemplary receiving section comprises:

a) a loop antenna shaped in the form of a figure eight, for efficiently receiving an electromagnetic wave oscillated from a resonance device, b) a local oscillator, c) a frequency converter for converting an electromagnetic wave received at the receiving section oscillated from an resonance device and a frequency oscillated from the local oscillator into a certain specific frequency (intermediate frequency), and d) a detecting section for detecting the level of electromagnetic wave of the intermediate frequency.

Other exemplary detection apparatus of the present invention may be formed by using a direct digital synthesizer for the local oscillator, which oscillates a frequency of the transmitting wave, as well as a frequency identical to the difference between the intermediate frequency and the transmitting frequency during receiving.

After exchanging a signal using an electromagnetic wave of a certain resonance frequency among the plurality of resonance frequencies, an invented detection apparatus can exchange signals by using other electromagnetic waves of different frequencies other than the one resonance frequency. Thus those signals oscillated from a plurality of resonance devices are detected with high reliability.

An system for controlling a moving vehicle comprises the above described resonance device buried in a road; with which system, a vehicle equipped with the above described detection apparatus automatically detects the resonance device, or the system provides a vehicle driver with driving support.

DESCRIPTION OF PREFERRED EMBODIMENTS

Descriptions are made below with reference to the drawings.

First Exemplary Embodiment

Figure 1:
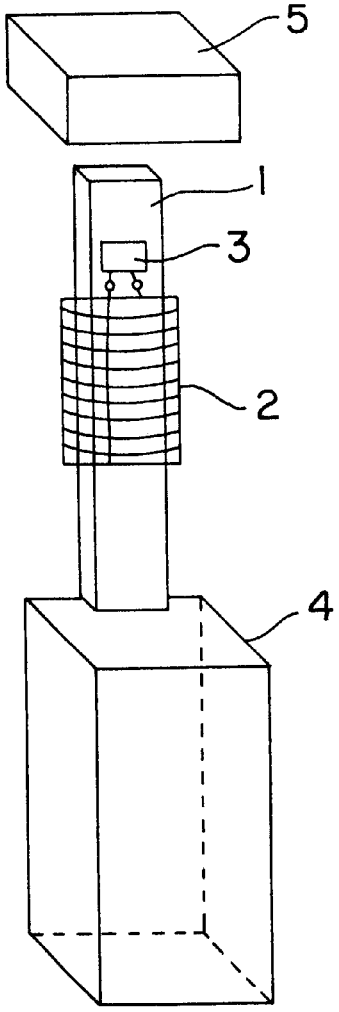
FIG. 1: An exploded view of an electric resonance element in a first exemplary embodiment of the present invention.
Figure 2:
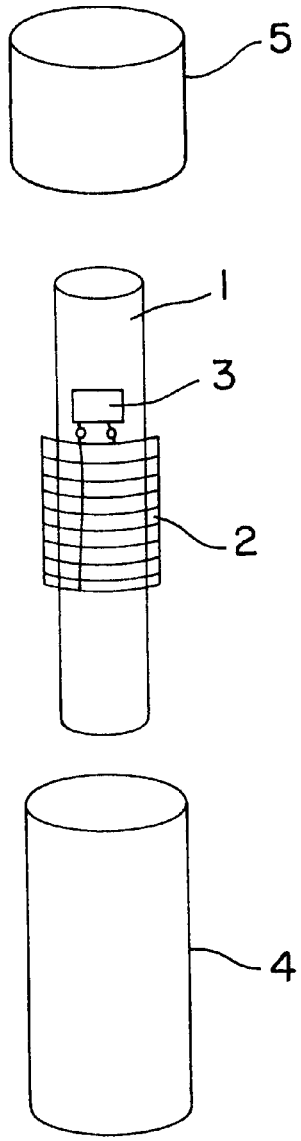
FIG. 2: An exploded view of an electric resonance element in a second exemplary embodiment of the present invention.

FIG. 1 and FIG. 2 are exploded views showing the structure of exemplary resonance devices. In FIG. 1 and FIG. 2, numeral 1 denotes a core of magnetic materials, such as a ferrite, shaped in the form of an approximately plate or a rod, 2 is a coil wound around said core, 3 is a capacitor. The core, coil and capacitor are housed in a vessel 4 sealed tight with a cover 5 to be protected against the outside environments. Any material may be used for the vessel in so far as it is a non-magnetic material.

Figure 3:
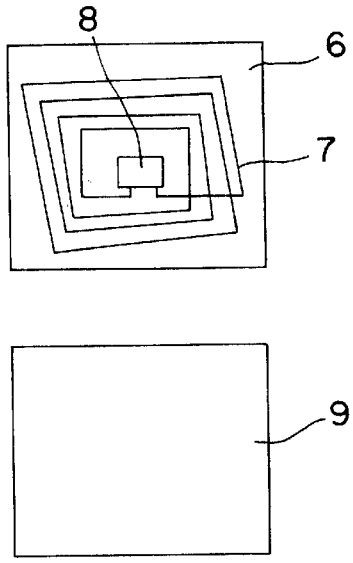
FIG. 3: An exploded view of a conventional electric resonator in a film shape.

FIG. 3 is an exploded view of a conventional electric resonator in a film shape. The conventional electric resonator is disposed on a base film 6 and a coil 7 made from metal foil adhered thereon, the coil 7 being coupled with a chip capacitor 8. Coil 7 may be made instead through printing of a conductive paste, or similar methods.

As may be understood from the comparison of FIGS. 1 and 2 with FIG. 3, the invented resonance device uses the magnetic core 1, and has sufficient spare space available. Therefore, the number of coil turns may be increased for obtaining a large impedance, also a capacitor 3 of larger capacitance may be used. Thus the resonance frequency of the resonance device may be substantially lowered, as compared with the case of conventional electric resonators.

Furthermore, using core 1 in the resonance device enables the ability to concentrate and select the high frequency magnetic flux of the transmitting wave, and to increase the signal. The power to be detected by a resonance device depends on such factors as the effective permeability, the cross sectional area and the length of the magnetic core, and the efficiency of a coil. In principle, the following formula (1) applies:

$$P=.k\mu\cdot Q \tag{1}$$

P: receiving power $\mu$: effective permeability

Q: coil efficiency k: proportional constant

As described in the above, an invented resonance device can take a large value in the $\mu$ and the Q in the formula (1). Namely, a great power may be detected and a capacitor of large capacitance can be used. As a result, the power of the transmitting wave can be stored for a certain period of time. Therefore, an invented resonance device can keep oscillating electromagnetic wave of the resonance frequency for a certain period of time after the transmitting wave is suspended.

Meanwhile, the invented detection apparatus has a feature, as described later, that as soon as a transmitting wave is transmitted the oscillation of the transmitting wave is immediately discontinued so as, to be ready to receive a wave spontaneous attenuation in accordance with the LC circuit constant does not occur.

Namely, in a system formed of the resonance device and the detection apparatus, the resonance device that has received a transmitting wave continues to oscillate a responding electromagnetic wave for a certain period of time even after the detection apparatus suspends transmitting its transmitting wave.

The resonance frequency of the resonance device may be set at an interval of approximately 30 kHz, starting from 90 kHz up to the bottom of the commercial broadcasting frequency band, 480 kHz.

Second Exemplary Embodiment

A detection apparatus is composed of a transmitting section for transmitting an electromagnetic wave of the resonance frequency of the resonance device, and a receiving section for detecting an electromagnetic wave from the resonance device.

Figure 4:
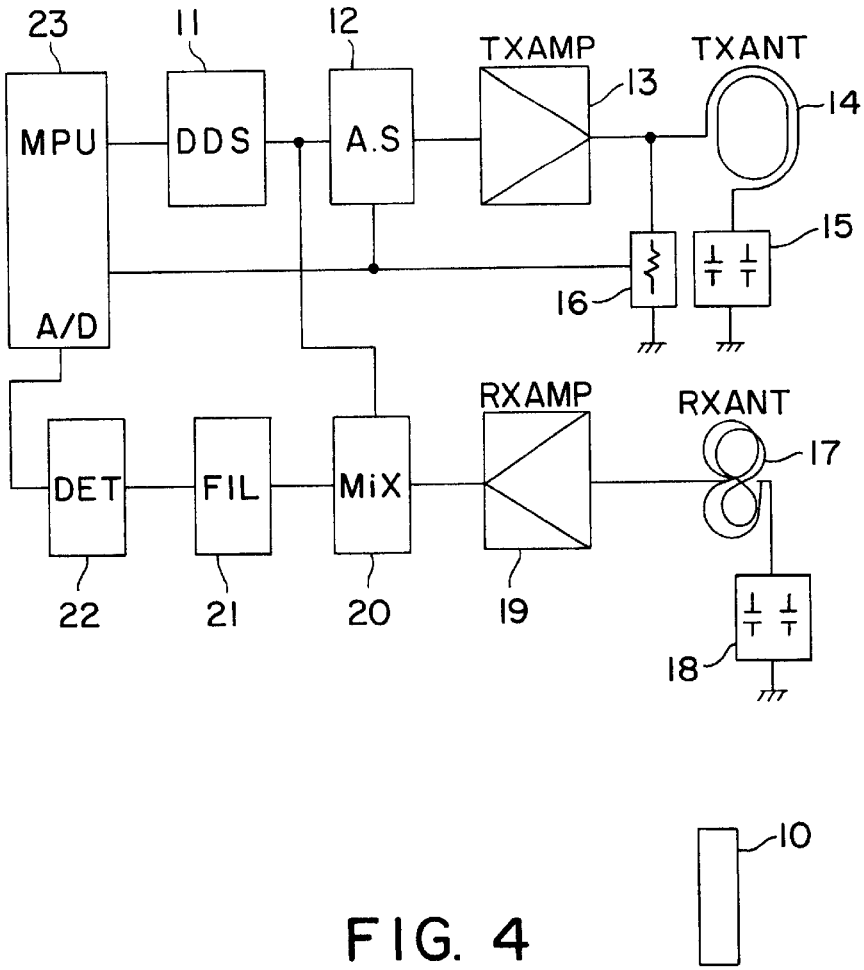
FIG. 4: A block diagram of a detection apparatus for detecting the electric resonance element.

The detection apparatus is described in detail referring to FIG. 4.

Figure 5:
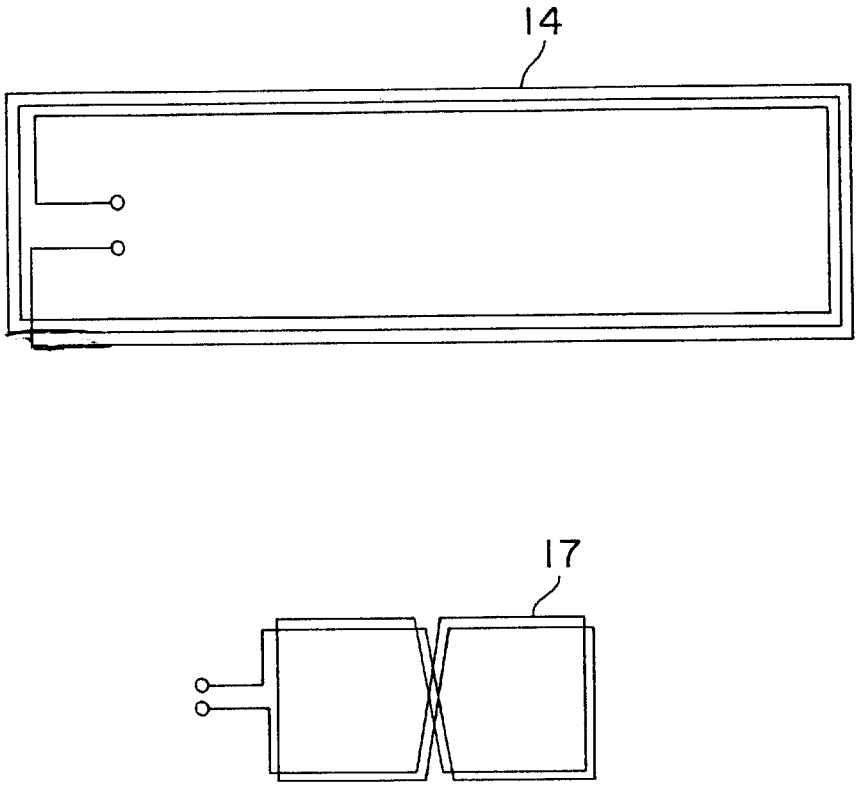
FIG. 5: An outline structure of a transmitting antenna and a receiving antenna in accordance with an exemplary embodiment of the present invention.

FIG. 4 is a block diagram of a detection apparatus in accordance with an exemplary embodiment of the present invention. In FIG. 4, numeral 23 denotes a microprocessor for controlling the entire system (hereinafter referred to as MPU), 11 is a direct digital synthesizer for transmitting an electromagnetic wave of the resonance frequency of resonance device, as well as transmitting an electromagnetic wave of a frequency that is identical to the difference between the resonance frequency and the intermediate frequency (hereinafter referred to as DDS), 12 is an alternating switch for switching the transmitting/receiving, 13 is a transmitting amplifier, 14 is a transmitting antenna, 15 is the tuning capacitors where an optimum capacitor is selected corresponding to a transmitting frequency, 16 is a discharge resistor for forcedly ending a transmission at the end of the transmission, 17 is a receiving antenna, 18 is the receiving tuning capacitors where an optimum capacitor is selected corresponding to a receiving frequency, 19 is a receiving amplifier, 20 is a frequency converter for converting a receiving signal into an intermediate frequency, 21 is a filter allowing only the intermediate frequency to pass, and 22 is an amplifier and detector. Numeral 10 represents a resonance device as described in embodiment 1. The receiving antenna 17 has been shaped in the form of a FIG. 8 in order to effectively set off unwanted incoming waves, as exemplified in FIG. 5.

The operation of the above detection apparatus of the present invention is described below.

In accordance with instructions from MPU 23, DDS 11 oscillates a resonance frequency f1 of the resonance device 10. The oscillated signal is sent to the alternating switch 12, and amplified at the transmitting amplifier 13 to be transmitted from the transmitting antenna 14. A capacitor suitable to the resonance frequency f1 is connected in series to one of the terminals of the transmitting antenna 14. The capacitor is selected in accordance with instructions from MPU 23.

The transmitting wave is received by the resonance device 10, and an electric resonance is created if the resonance frequency f1 is within a resonance range of the resonance device 10.

Next, in accordance with the instruction from the MPU 23, the detection apparatus is switched to a receiving state. By the instruction from the MPU 23, the discharge resistor 16 is put into operation to attenuate the transmitting output within a short period of time. A receiving tuning capacitor 18 matching the resonance frequency f1 is selected and is connected to one of the terminals of the receiving antenna 17.

An electromagnetic wave having the frequency identical to the difference between an intermediate frequency fc and the resonance frequency f1 is oscillated from the DDS 11 to be mixed at the frequency converter 20. At the same time, the alternating switch 12 is switched to a receiving state.

An echo signal transmitted from the resonance device 10 is received by the receiving antenna 17 and amplified at the receiving amplifier 19. The amplified echo signal is converted at the frequency converter 20 into an intermediate frequency, and sent via the filter 21 to the amplifier and detector 22 to be detected as a signal received.

The signal received and detected is delivered to the MPU 23 through an input terminal of an A/D converter for processing.

The detection apparatus uses a DDS 11 both for the transmitting and for the receiving. While a transmitting section of the detection apparatus is on duty of transmission, a receiving section is out of duty staying in a waiting state. Therefore, the receiving sector typically is not saturated with the transmitted wave; it immediately becomes ready for receiving as soon as it is switched to a receiving state from a transmitting state.

Furthermore, the detection apparatus converts the received signal into an intermediate frequency by a heterodyne process and delivers it through a filter circuit for the amplification and detection in order to distinguish signals from the resonance device 10 having a plurality of resonance frequencies. As a result, an echo wave is efficiently separated out of those from the resonance device 10 having different resonance frequencies.

As described in the above, by using the resonance device and the detection apparatus, the detection apparatus is able to detect a targeted signal without being affected by a transmitting wave oscillated by itself. Therefore, even a resonance device is located in a place away from a detection apparatus the information can be exchanged with a high accuracy. The directional characteristics are also improved along with the use of an antenna to be referred to later.

The information exchange between a vehicle running at a high speed and a resonance device buried in a road or set on a road, which was difficult with a conventional system, becomes possible by using the present exemplary embodiments.

Third Exemplary Embodiment

Figure 6:
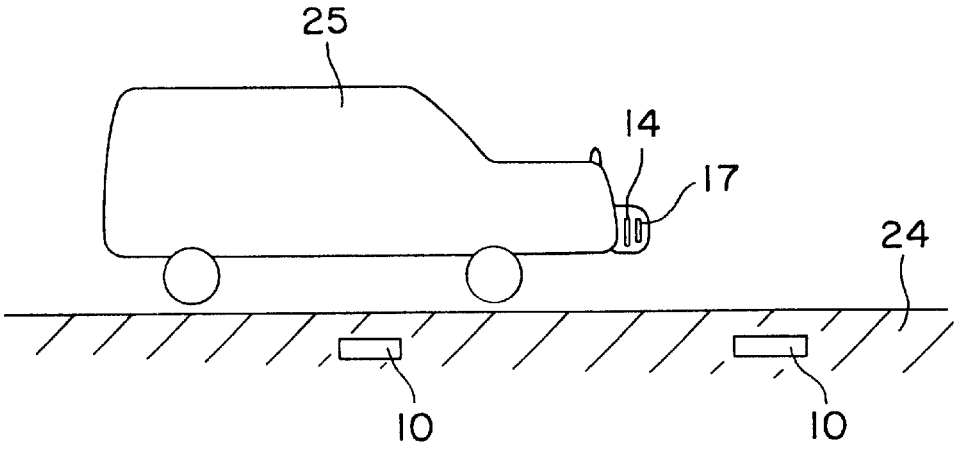
FIG. 6: A schematic illustration of a system for controlling a moving vehicle, using an electric resonance element and a detection apparatus for detecting the electric resonance element.

A system for controlling a moving vehicle using the resonance device and the detection apparatus is described as a third exemplary embodiment of the present invention. The description is made below referring to FIG. 6.

The present control system for a moving vehicle comprises a resonance device 10 of embodiment 1 buried under a road 24, and a detection apparatus of embodiment 2 installed on a vehicle 25. The vehicle 25 having the detection apparatus receives an echo wave transmitted from the resonance device 10 and detects it for obtaining the road information or the driving information.

A transmitting antenna 14 on the vehicle 25 transmits an electromagnetic wave of a certain resonance frequency specific to the resonance device 10 one after another. If the resonance device 10 is located in a place within reach of the electromagnetic wave transmitted, the resonance device 10 transmits an echo wave. A receiving antenna 17 on the vehicle 25 receives the echo wave, which is detected by the detection apparatus on board. The detection apparatus acquires information about the relative relationship between the vehicle and the road. The information is accumulated in the detection apparatus to be used as information for the automatic driving of a vehicle.

Each of the transmitting antenna 14 and the receiving antenna 17 of the detection apparatus is provided with tuning capacitors 15, 18 respectively. Therefore, the resonance device 10 may be classified into a plurality of categories of different resonance frequencies, in order to obtain different information from them.

An office of road administration can make road information available for a moving vehicle, by placing the resonance devices 10 having different resonance frequencies in a road in a continual arrangement with a certain interval relative to each other. Or, different information may be provided with one resonance device 10. Thus an office of road administration can provide a desirably safe and sure system for moving vehicles.

As resonance device 10 is buried in road 24 in the present exemplary embodiment, the durability of the resonance device 10 can be improved as compared to a case where such a device is mounted on a side wall, etc. of a road. Although a transmitting antenna and a receiving antenna have been provided independently one for one in the above description, a plurality of receiving antennas may be provided for one transmitting antenna.

Moreover, the resonance device 10 can be placed at a location such as a side wall if the complete packaging can be made.

What is claimed is:

1. A detection apparatus for detecting an electric resonance body including an electronic circuit comprising:

a) a transmitter which oscillates a first electromagnetic wave to produce an electric resonance in said electronic circuit, b) a receiver which uses a heterodyne process based on said first electromagnetic wave to detect a second electromagnetic wave received from said electric resonance body, and c) a controller for controlling operations of said transmitter and said receiver, said controller at least partially suspending operation of an element or a circuit of said receiver while said transmitter is transmitting said first electromagnetic wave, said controller suspending transmission of said first electromagnetic wave to avoid interference between said second electromagnetic wave and said first electromagnetic wave and to maintain a receiving period of said second electromagnetic wave, wherein said second electromagnetic wave spontaneously continues according to a circuit constant of said transmitter.

2. The detection apparatus of claim 1, further comprising a discharge resistor, for suspending transmitting output, through which current flows when transmitting stops and receiving starts.

3. The detection apparatus of claim 1, wherein said transmitter transmits a plurality of electromagnetic waves.

4. The detection apparatus of claim 3, further comprising a plurality of tuning capacitors corresponding to electromagnetic waves respectively, and switches for selecting one of said capacitors corresponding to a transmitting frequency of said first electromagnetic wave.

5. The detection apparatus of claim 1, wherein an antenna of the receiving section is shaped in the form of a figure eight.

6. The detection apparatus of claim 1, further comprising a) a frequency converter for converting the frequency of said second electromagnetic wave generated by said electric resonance body upon receiving the second electromagnetic wave, and b) a detector for detecting the level of said converted electromagnetic wave.

7. The detection apparatus of claim 6, further comprising a local oscillator for oscillating a) said first electromagnetic wave; and b) an electromagnetic wave of a certain frequency used for converting the second electromagnetic wave.

8. The detection apparatus of claim 7, wherein said local oscillator includes of a single direct digital synthesizer.

9. The detection apparatus of claim 1, wherein the first and second electromagnetic waves each change frequency.

* * * * *

UNITED STATES PATENT AND TRADEMARK OFFICE

CERTIFICATE OF CORRECTION

PATENT NO. : 6,518,884 B1
DATED : February 11, 2003
INVENTOR(S) : Tanji et al.

It is certified that error appears in the above-identified patent and that said Letters Patent is hereby corrected as shown below:

Title page,
Item [56], References Cited, U.S. PATENT DOCUMENTS, insert
-- 3,816,708 6/1974 Walton
6,100,821 8/2000 Tanji et al.
4,546,241 10/1985 Walton --

Signed and Sealed this

Fourth Day of November, 2003

JAMES E. ROGAN
*Director of the United States Patent and Trademark Office*